US009611740B2

(12) United States Patent
Van Buskirk et al.

(10) Patent No.: US 9,611,740 B2
(45) Date of Patent: Apr. 4, 2017

(54) PNEUMATIC ACTUATORS

(71) Applicants: Loyd C. Van Buskirk, Brownsdale, MN (US); Brian R. Meldahl, Brownsdale, MN (US); Dylan C. Van Buskirk, Brownsdale, MN (US)

(72) Inventors: Loyd C. Van Buskirk, Brownsdale, MN (US); Brian R. Meldahl, Brownsdale, MN (US); Dylan C. Van Buskirk, Brownsdale, MN (US)

(73) Assignee: L & B Manufacturing, Inc., Brownsdale, MN (US)

( * ) Notice: Subject to any disclaimer, the term of this patent is extended or adjusted under 35 U.S.C. 154(b) by 348 days.

(21) Appl. No.: 14/087,261

(22) Filed: Nov. 22, 2013

(65) Prior Publication Data

US 2015/0143990 A1 May 28, 2015

(51) Int. Cl.
*F15B 15/10* (2006.01)
*F01B 19/04* (2006.01)
*F04B 43/00* (2006.01)

(52) U.S. Cl.
CPC ..... *F01B 19/04* (2013.01); *F04B 43/00* (2013.01); *F15B 15/103* (2013.01)

(58) Field of Classification Search
CPC ..... F15B 19/04; F15B 15/103; F15B 15/12
See application file for complete search history.

(56) References Cited

U.S. PATENT DOCUMENTS 2,297,900 A * 10/1942 Lee ..... 15/250.18
2,467,883 A * 4/1949 Edwards ..... B30B 1/003 92/101
3,137,214 A * 6/1964 Jack et al. ..... 92/48
3,155,019 A * 11/1964 Stiglic ..... B64C 9/38 91/51
4,800,723 A * 1/1989 Clotn ..... B25J 3/04 60/390
4,886,174 A * 12/1989 Leveugle ..... F15B 15/103 212/195
5,079,998 A * 1/1992 Peterson et al. ..... 92/48
5,568,761 A * 10/1996 Legendre ..... F15B 11/0365 92/128
6,382,659 B1 5/2002 Simard
(Continued)

FOREIGN PATENT DOCUMENTS

DE WO2005049346 6/2005
DE EP2540537 A1 1/2013
(Continued)

OTHER PUBLICATIONS

Notification of Transmittal of the International Search Report and the Written Opinion of the International Searching Authority, Apr. 30, 2015.

*Primary Examiner* — F. Daniel Lopez
(74) *Attorney, Agent, or Firm* — C. G. Mersereau; Nikolai & Mersereau, P.A.

(57) ABSTRACT

A bi-directional pneumatic actuating unit includes a unitary structure having a central base member, a pair of opposed inflatable pneumatic chambers for applying force in different directions, one mounted on either side of the central base member, and air supply and exhaust access ports connected to each of the pneumatic chambers for selectively supplying air to and exhausting air from each of the pneumatic chambers.

8 Claims, 8 Drawing Sheets

(56) References Cited

U.S. PATENT DOCUMENTS

| | | | | |
|---|---|---|---|---|
| 7,247,778 | B2 | 7/2007 | Chase et al. | |
| 7,396,089 | B2 | 7/2008 | Bennett et al. | |
| 8,127,659 | B2 * | 3/2012 | Okazaki | 91/358 R |
| 8,534,373 | B2 | 9/2013 | Van Buskirk et al. | |

FOREIGN PATENT DOCUMENTS

| | | |
|---|---|---|
| EP | 0284736 | 8/1990 |
| EP | 2560915 B1 | 2/2013 |
| WO | WO 91/11642 | 8/1991 |

* cited by examiner

PNEUMATIC ACTUATORS

CROSS-REFERENCED TO RELATED APPLICATIONS

Not applicable

STATEMENT REGARDING FEDERALLY SPONSORED RESEARCH OR DEVELOPMENT

Not applicable

BACKGROUND OF THE INVENTION

I. Field of the Invention

The present invention relates generally to a field including various types of machinery or other devices that can make use of pneumatic actuators for providing deployment and retraction forces during use. More specifically, the present invention relates to a pneumatic actuating system having opposed inflatable pneumatic chambers that enable bi-directional operation.

II. Related Art

Pneumatic actuating systems of a variety of types have been associated with the operation of many devices for some time, including mechanical implements of varying kinds. An example of such a concept is illustrated and described in U.S. Pat. No. 8,534,373 B2, which shows the use of multiple airbag units to deploy and retract a variety of field-conditioning implements. It would provide a distinct advantage if a compact bi-directional pneumatic actuating unit could be provided to deploy and retract various devices.

SUMMARY OF THE INVENTION

By means of the present invention, there is provided a pneumatic actuator unit concept which includes a unitary structure that has dual inflatable pneumatic air chambers mounted on and fixed to a common central base member or plate member that provides a base for both of directions with respect to the base member. The operating air may be supplied by way of access ports in the end of the pneumatic chambers remote from the central base member or via access ports located in the central base member which may include trunnions for mounting. The air chambers are preferably airbag devices which may be sleeve-type airbags, single or multiple convoluted airbags or other inflatable apparatuses.

The pneumatic actuating units of the present invention may be mounted in an arrangement in which the position of each of the remote ends of opposed pneumatic chambers is fixed so that the central base member can be used to apply force and move a load according to the inflation of the opposed pneumatic chambers. The pneumatic actuating unit may also be mounted in a manner that fixes the position of the central base member and allows the ends of the opposed pneumatic chambers remote from the central base member to apply force based on the inflation of the opposed pneumatic chambers and move a load accordingly.

It should be noted that inflatable pneumatic operators in the form of conventional airbags have been found to be a preferred type of pneumatic operator, but other such devices could also be used.

The term "airbag", as used herein, is defined to mean any type of inflatable pneumatic operator, without limitation, including convoluted and non-convoluted devices with single and multiple air access ports, and ports at different locations. Single and double-acting units are also included.

The present invention employs opposed units which may function as lift and down-force airbags.

BRIEF DESCRIPTION OF THE DRAWINGS

The foregoing features and advantages of the invention will become apparent to those skilled in the art from the following detailed description of one or more preferred embodiments, especially when considered in conjunction with the accompanying drawings in which like numerals depict like parts.

DETAILED DESCRIPTION

Figure 1A:
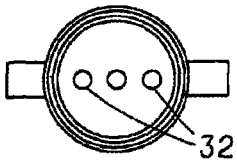
FIG. 1A is a top view of one embodiment of a pneumatic actuating unit in accordance with the invention with outer end air fittings.
Figure 1B:
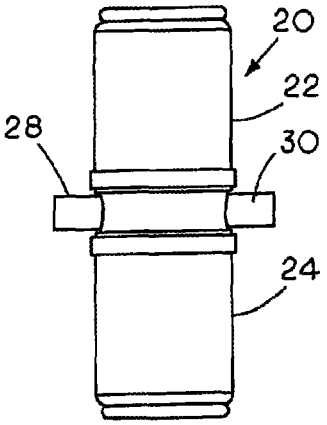
FIGS. 1B and 1C are elevational views of the pneumatic actuating unit of FIG. 1A.
Figure 1C:
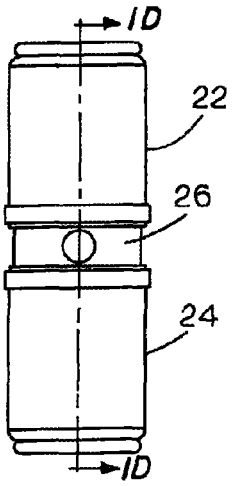
Figure 1D:
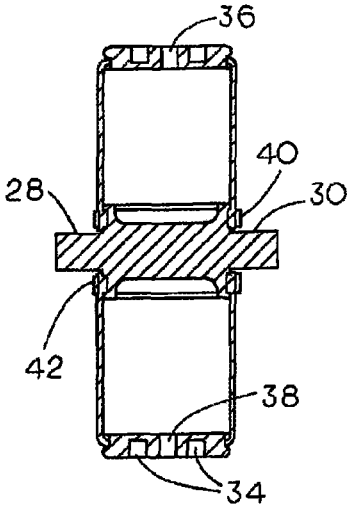
FIG. 1D is a sectional view along line d-d of FIG. 1C.

The detailed description of the illustrative embodiments is intended to illustrate representative examples of the inventive concepts and is not intended to exhaust or limit the scope of those concepts. The examples are to be read in connection with the accompanying drawings, which are to be considered part of the entire written description of this invention. In the description, relative terms such as "lower", "upper", "horizontal", "vertical", "above", "below", "up", "down", "top" and "bottom", "left" and "right", as well as derivatives thereof (e.g., "horizontally", "downwardly", "upwardly", etc.) should be construed to refer to the orientation as then described or as shown in the drawings under discussion. These relative terms are for convenience of description and do not require that the apparatus be constructed or operated in a particular orientation. Terms such as "connected", "connecting", "attached", "attaching", "join" and "joining" are used interchangeably and refer to one structure or surface being secured to another structure or surface or integrally fabricated in one piece, unless expressively described otherwise.

FIGS. 1A-1D depict one embodiment of a bi-directional pneumatic actuating unit generally at 20 having an upper pneumatic or air chamber 22, an opposed lower pneumatic or air chamber 24, and a central base member which includes opposed trunnions 28 and 30. The unit may include upper bolt holes or recesses 32 and lower bolt holes or recesses 34 and an upper air chamber air filling port 36 and a lower air chamber filling port 38 located at the outer or remote ends of the air chambers. Upper air chamber 22 is peripherally fixed to the central base or plate member 26 at 40 and the lower air chamber is similarly fixed to the base member 26 at 42. The air chambers illustrated are sleeve-type airbags.

Figure 4A:
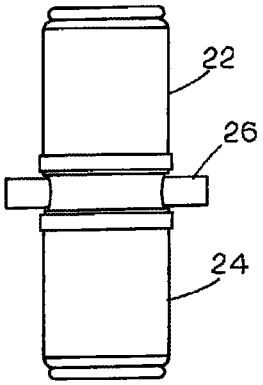
FIGS. 4A-4C illustrate views of yet another modified embodiment of a pneumatic actuating unit of the invention similar to that of FIGS. 3A-3D, but in which air access is provided through trunnions of the central base member.
Figure 4B:
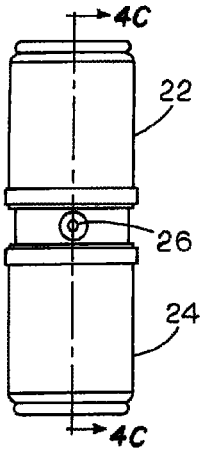
Figure 4C:
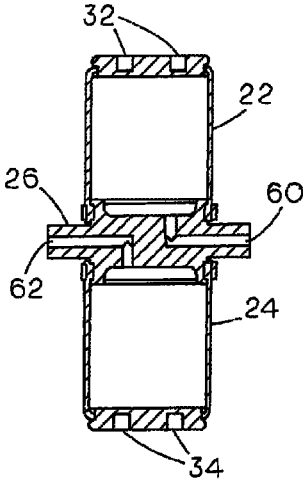
Figure 5A:
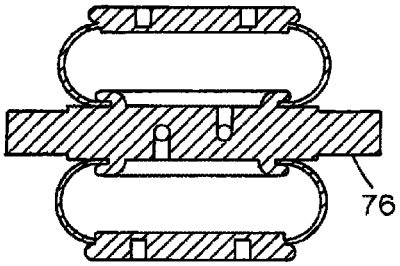
FIGS. 5A-5D provide views of another embodiment of a pneumatic actuating unit in accordance with the invention which utilizes single convoluted airbags joined together by a central plate member with air access provided through the side of the plate member.
Figure 5B:
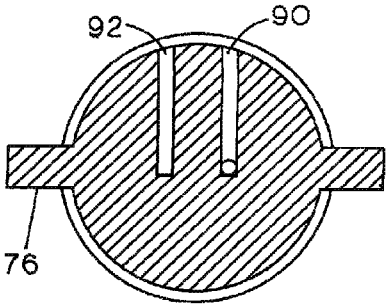
Figure 5C:
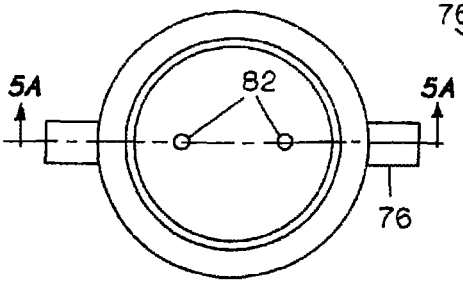

FIGS. 3A-3D and 4A-40 illustrate other embodiments of a pneumatic actuating unit, which are of a construction similar to that illustrated in FIGS. 1A-1D with certain variations. Thus, in FIGS. 3A-3D, air access ports for the upper air chamber 22 and lower air chamber 24 are provided in the central base member as at 50 and 52, respectively. Likewise, FIGS. 4A-4C depict views of another embodiment that also differs only in the location of the air ports. In this embodiment, upper air chamber air access port 60 and lower air chamber access port 62 are located in the trunnions of the central base member 26.

Figure 2A:
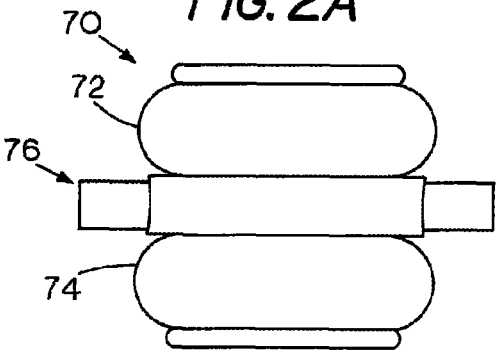
FIGS. 2A and 2B are elevational views of another embodiment of a pneumatic actuating unit in accordance with the invention with outer end air fittings.
Figure 2B:
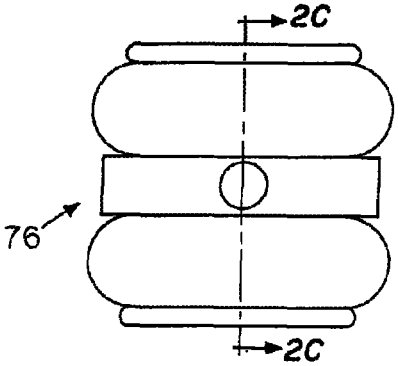
Figure 2C:
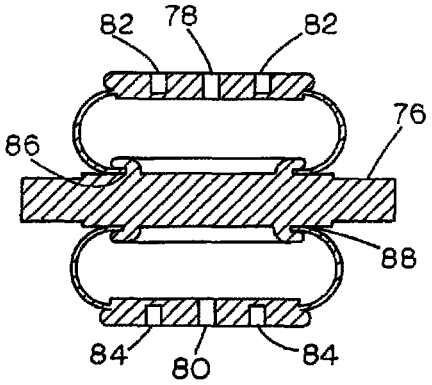
FIG. 2C is a sectional view along line c-c of FIG. 2B.
Figure 3C:
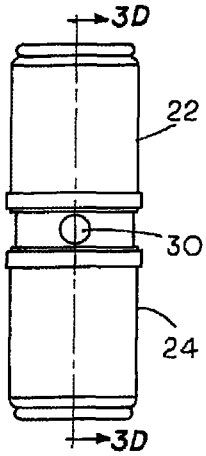
FIGS. 3A-3D illustrate views of another embodiment of a pneumatic actuating unit in accordance with the invention in which the air fittings are provided in the central base member.
Figure 3A:
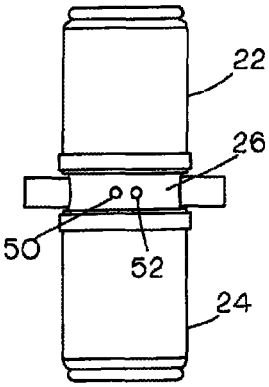
Figure 3D:
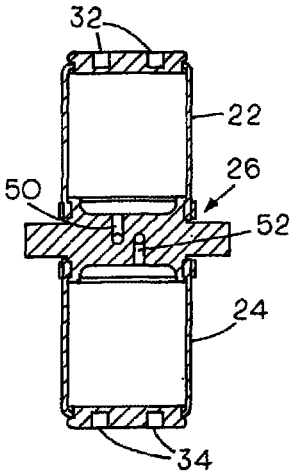
Figure 3B:
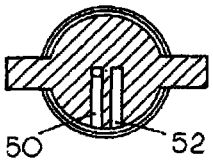

FIGS. 2A-2C depict elevation and sectional views of another embodiment of a bi-directional pneumatic actuating unit generally at 70 in which opposed single convoluted upper and lower airbags 72 and 74, respectively, are fixed to a central base member 76. In this embodiment, air fitting access ports are located in the top and bottom outward ends of opposed airbags 72 and 74 at 78 and 80, respectively. As with other embodiments, bolt connection recesses are shown at 82 and 84. These airbags are fixed to the central base member 76 peripherally at 86 and 88.

Figure 6B:
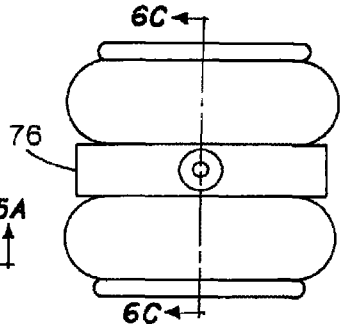
FIGS. 6A-6C illustrate an embodiment similar to that illustrated in FIGS. 5A-5D, but with the air access ports located in the trunnions of the central plate member.
Figure 6C:
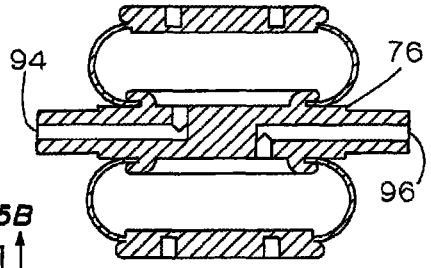
Figure 5D:
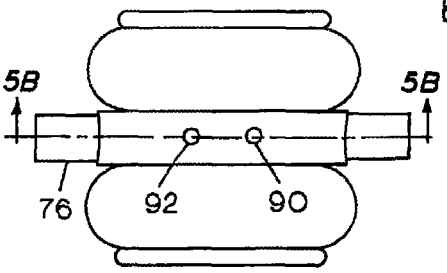
Figure 7A:
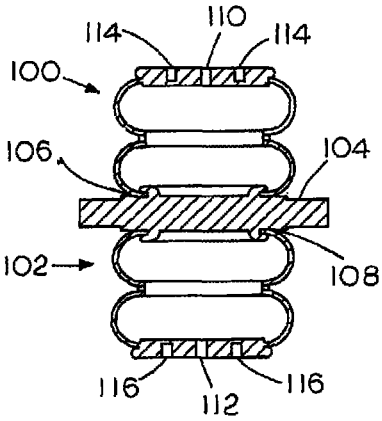
FIGS. 7A-7D illustrate an embodiment of the pneumatic actuating unit in accordance with the invention utilizing double convoluted airbags with outer end air fittings.
Figure 6A:
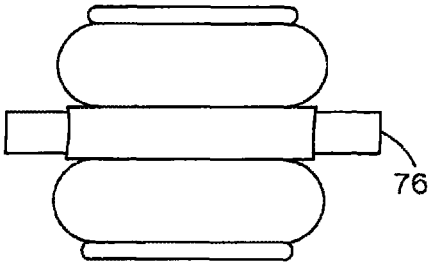
Figure 7B:
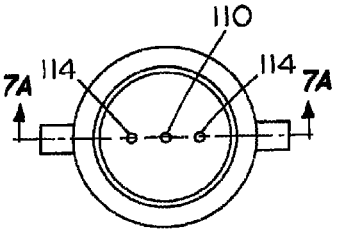
Figure 8A:
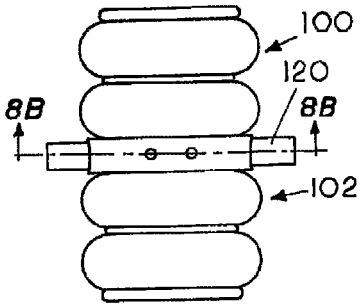
FIGS. 8A-8D illustrate an embodiment similar to that in FIGS. 7A-7D with air access through the central plate member.
Figure 7C:
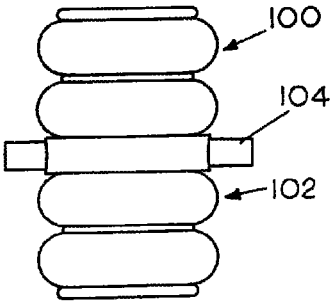
Figure 8B:
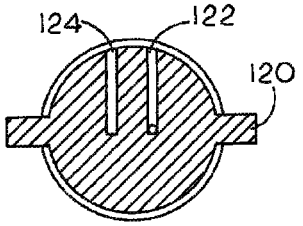
Figure 7D:
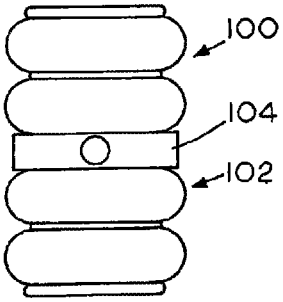
Figure 8C:
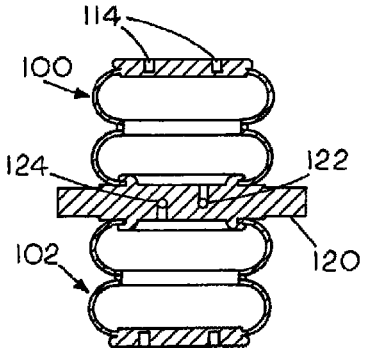
Figure 8D:
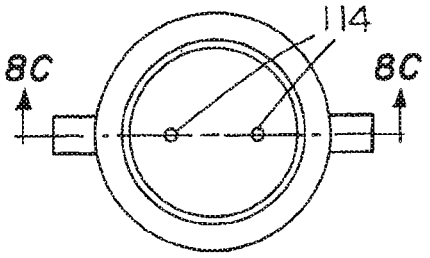

FIGS. 5A-5D and 6A-6C depict view of other embodiments that are variations on the embodiment of FIGS. 2A-2C in which the air access fillings or ports are located in the central base member. Thus, in the embodiments of FIGS. 5A-5D, upper and lower air access ports are in the side of central base member 76 at 90 and 92, respectively. In the embodiment of FIGS. 6A-6C, upper and lower air access ports 94 and 96 are located in the trunnions of the central base member 76.

FIGS. 7A-7D, 8A-8D and 9A-9C depict views of embodiments that are similar to those of FIGS. 2A-2C, 5A-5D and 6A-6C using convoluted airbags that have a plurality of convolutions. In FIGS. 7A-7D, the unit includes an upper double convoluted airbag 100 and lower double convoluted airbag 102 with central base member includes an upper double convoluted airbag 100 and lower double convoluted airbag 102 with central base member 104.

The upper airbag 100 is fixed peripherally to the central base member 104 at 106 and the lower airbag 102 is fixed in a like manner at 108. In this arrangement, air access ports are provided at the outer extremes of the upper and lower airbags at 110 and 112, respectively. Attachment recesses are shown at 114 and 116.

Figure 9A:
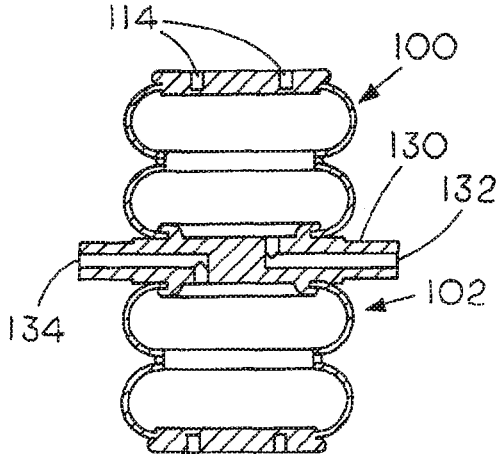
FIGS. 9A-9C depict an embodiment similar to that of FIGS. 8A-8D with the air access ports located in the trunnions of the central base member.
Figure 9B:
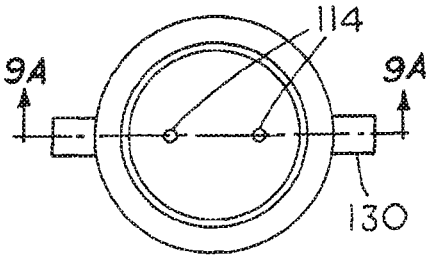
Figure 9C:
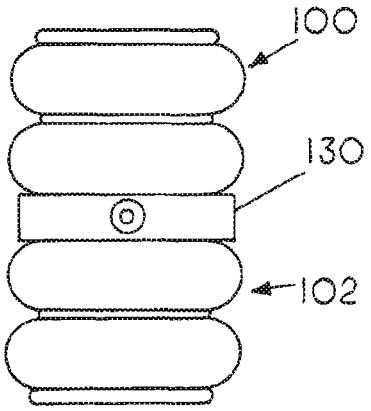

Similarly constructed arrangements are shown in FIGS. 8A-8D and 9A-9C with the exception of the location of the air access ports, which are located in the central base members. In the case of FIGS. 8A-8D, the air access ports are located in central base member 120 at 122 and 124 as upper and lower access ports. In the embodiment of FIGS. 9A-9C, the air access ports are provided through the trunnions of central base member 130 at 132 (upper) and 134 (lower).

Figure 10A:
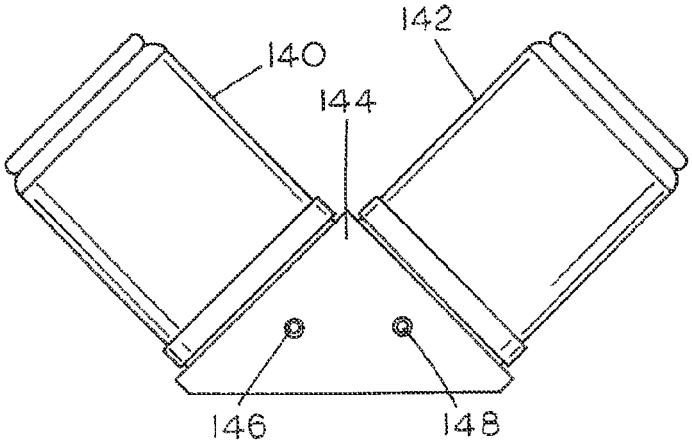
FIG. 10A is a side view of another embodiment of the invention in which the actuating unit has pneumatic chambers that are not aligned back-to-back with air access ports between the chambers.
Figure 10B:
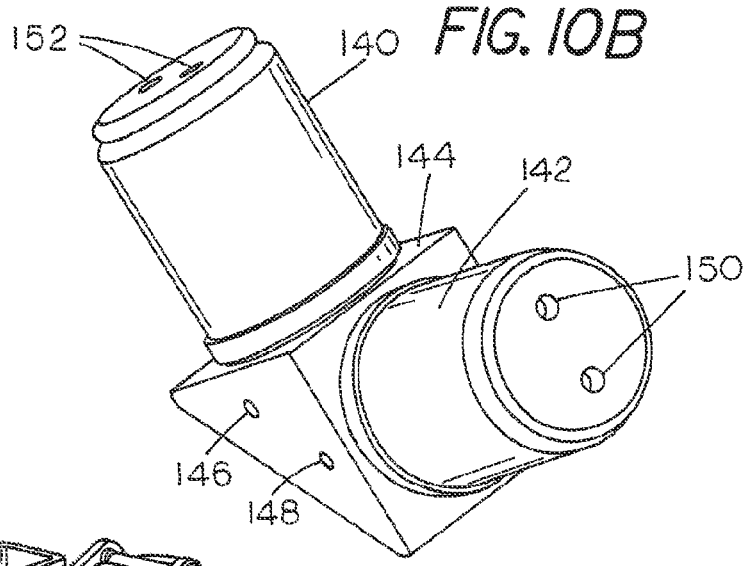
FIG. 10B is a perspective view of the embodiment of FIG. 10A.

FIGS. 10A and 10B depict another embodiment in which the opposed inflatable pneumatic chambers are not aligned back-to-back, but at an angle determined by the shape of the intermediate mount. Inflatable chambers 140 and 142 are separated by a wedge-shaped intermediate mount 144 which has corresponding air access ports at 146 and 148. Connection openings are shown at 150 and 152.

Figure 11A:
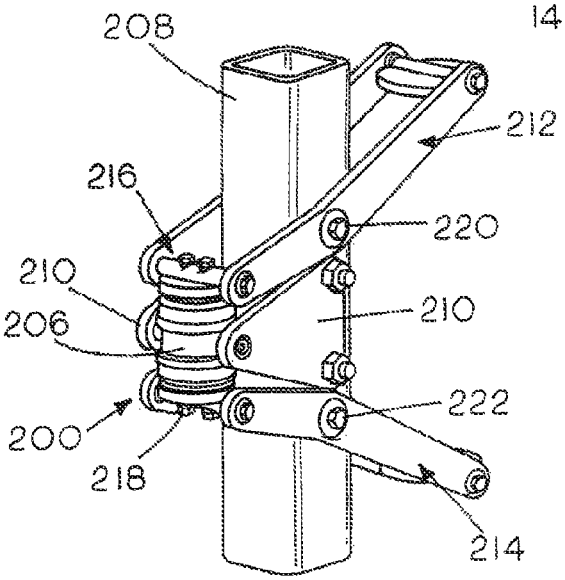
FIGS. 11A and 11B are perspective views showing the operation of a pneumatic actuating unit in accordance with the invention in which the central base member is fixed and the remote ends of the chambers are attached to operate a mechanical device.
Figure 11B:
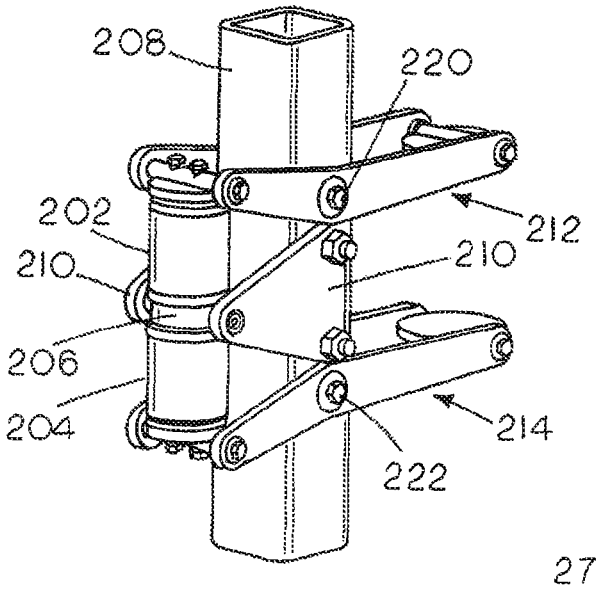

FIGS. 11A and 11B illustrate one mounting mode of a pneumatic actuating unit in accordance with the invention. The unit, generally 200, includes an upper airbag 202, a lower airbag 204 and a central base member 206. The central base member 206 is fixed to a structural beam member 208 by gusset plates 210, as shown. The outer or remote ends of the airbags 202 and 204 are connected to upper and lower operating linkage assemblies 212 and 214, respectively at 216 and 218, about an attachment point illustrated at 222.

As shown in FIG. 11A, the airbags 202 and 204 are both collapsed causing the assemblies 212 and 214 to assume a fully separated position. Conversely in FIGS. 11B, the airbags 202 and 204 are shown fully inflated forcing the assemblies 212 and 214 to assume a closed or closer together position. It will be understood that with the central base member mounted in a fixed position, either or both airbags can be inflated in a controlled position to exert forces away from the central base member.

Figure 12A:
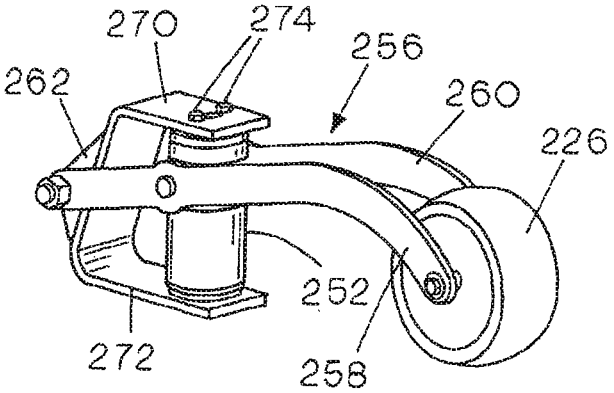
FIGS. 12A and 12B depict the operation of a pneumatic actuating unit in accordance with the invention in which the remote ends of the pneumatic chambers are fixed in position and the movement of the central base member is utilized to perform a mechanical function.
Figure 12B:
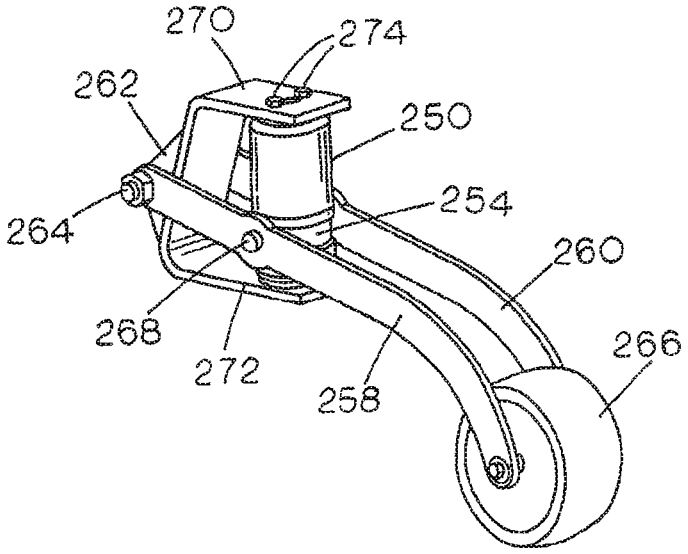

FIGS. 12A and 12B illustrate another mounting arrangement for the pneumatic actuating units of the invention. In that arrangement, an actuating unit is shown with opposed upper and lower airbags 250 and 252 mounted on central base member 254. A mounting yoke arrangement 256 with arm members 258 and 260 is pivotally attached to plates 262 as at 264. A wheel 266 is mounted at the other end of the yoke 256. The members 258 and 260 are further fixed to central base member 254 as at 268. The unit is fixed to the flanges 270 and 272 of a mount as at 274 so that the ends of the unit cannot move. As can be seen in the drawing figures, inflation of the lower airbag 252 deflated upper airbag 250 and raises the wheel 266. Conversely, inflation of the upper airbag 250 collapses the lower airbag 252 and lowers the wheel 266. Of course, air can be supplied to both bags to adjust the net upward or downward force as desired.

An important aspect of the present invention is the unitary construction of the bi-directional actuating system that utilizes a common central base to mount opposed pneumatic devices that can apply force in two directions by two modes. The mounting of the unit and the location of the air access ports or fillings can be arranged to best suit the particular application.

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. A bi-directional pneumatic actuating unit having a plurality of inflatable pneumatic chambers, comprising:

(a) a central base member wherein said central base member further comprises trunnions;

(b) a pair of opposed inflatable pneumatic chambers for applying force in different directions, one mounted on either side of said central base member; and (c) air supply and exhaust access ports connected to each of said pneumatic chambers for selectively supplying air to and exhausting air from each of said pneumatic chambers and wherein said air supply and exhaust parts are located in said trunnions.

2. A pneumatic actuating unit as in claim 1 wherein said pneumatic chambers are sleeve-type airbags.

3. A pneumatic actuating unit as in claim 1 wherein said pneumatic chambers are multiple convoluted airbags.

4. A pneumatic actuating unit as in claim 1 wherein said pneumatic chambers are single convoluted airbags.

5. A pneumatic actuating unit as in claim 1 wherein said pair of opposed pneumatic chambers are aligned in a straight line.

6. A pneumatic actuating unit as in claim 1 wherein said pair of opposed pneumatic chambers are aligned at an angle.

7. A bi-directional pneumatic actuating unit comprising:

(a) a pair of inflatable pneumatic chambers mounted on a wedge-shaped intermediate mount wherein a directional alignment angle between the inflatable chambers is determined by the shape of the intermediate mount; and (b) air supply and exhaust access ports for the inflatable chambers located in said intermediate mount for inflating and deflating said inflatable pneumatic chambers.

8. A bi-directional pneumatic actuating unit as in claim 7 wherein said pneumatic chambers are selected from sleeve-type and convoluted airbags.

* * * * *